US011261836B1

(12) United States Patent
Woodring et al.

(10) Patent No.: US 11,261,836 B1
(45) Date of Patent: Mar. 1, 2022

(54) FUEL SYSTEM CHECK VALVE

(71) Applicant: Ford Global Technologies, LLC, Dearborn, MI (US)

(72) Inventors: Christopher Arnold Woodring, Canton, MI (US); Ross Pursifull, Dearborn, MI (US); Steven Antone Thiel, Chelsea, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/196,938

(22) Filed: Mar. 9, 2021

(51) Int. Cl.
*F02M 59/46* (2006.01)

(52) U.S. Cl.
CPC ..... *F02M 59/462* (2013.01); *F02M 59/464* (2013.01); *F02M 2200/60* (2013.01)

(58) Field of Classification Search
CPC ..... F02M 59/464; F02M 2200/60
See application file for complete search history.

(56) References Cited

U.S. PATENT DOCUMENTS 5,447,175 A * 9/1995 Takaki ..... B60K 15/077 137/399
6,463,914 B2 * 10/2002 Augustin ..... F02M 57/025 123/467
6,951,209 B2 * 10/2005 Yanase ..... F02M 25/0836 123/516
6,988,488 B2 * 1/2006 Pursifull ..... F02M 37/0029 123/467
7,066,152 B2 6/2006 Stroia et al.
8,291,707 B2 * 10/2012 Williams ..... F23K 5/147 60/741
8,434,461 B2 5/2013 Kerns et al.
8,740,579 B2 * 6/2014 Aritomi ..... F02M 59/462 417/311
9,915,363 B2 * 3/2018 Mori ..... F16K 15/08
10,012,322 B2 * 7/2018 Mori ..... F16K 15/026
11,098,710 B2 * 8/2021 Pellini ..... F02M 63/0075
2002/0000219 A1 * 1/2002 Augustin ..... F02M 57/025 123/502
2004/0055582 A1 * 3/2004 Yanase ..... F02M 25/0836 123/519
2004/0206338 A1 * 10/2004 Pursifull ..... F02M 69/54 123/510
2004/0250795 A1 12/2004 Stroia et al.
2006/0220446 A1 * 10/2006 Jensen ..... F02M 59/462 303/3

(Continued)

FOREIGN PATENT DOCUMENTS

DE 102019100848 A1 7/2019
JP 2005030367 A 2/2005

OTHER PUBLICATIONS

Pursifull, R., "Fuel Rail Pressure Relief," Proceedings of the 2006 SAE World Congress, Apr. 3, 2006, Detroit, Michigan, 13 pages.

*Primary Examiner* — Kevin R Steckbauer
(74) *Attorney, Agent, or Firm* — Geoffrey Brumbaugh; McCoy Russell LLP

(57) ABSTRACT

A fuel line check valve system and a fuel system that includes the fuel line check valve system are described. The fuel line check valve system may prevent flow into a fuel system that is generated via a vacuum in the fuel system. The fuel line check valve system may also remain in an open state after it is open via a reduced pressure.

20 Claims, 6 Drawing Sheets

(56) References Cited

U.S. PATENT DOCUMENTS

| | | | | |
|---|---|---|---|---|
| 2008/0023079 | A1* | 1/2008 | Dickenscheid | F02M 59/462 137/511 |
| 2010/0037615 | A1* | 2/2010 | Williams | F02C 7/232 60/741 |
| 2011/0123376 | A1* | 5/2011 | Aritomi | F02M 59/462 417/540 |
| 2013/0312852 | A1* | 11/2013 | Dickenscheid | F02M 63/0054 137/535 |
| 2015/0337769 | A1* | 11/2015 | Yoshioka | F02D 19/022 137/512 |
| 2016/0123484 | A1* | 5/2016 | Mori | F16K 47/023 137/512 |
| 2018/0135767 | A1* | 5/2018 | Mori | F16K 15/026 |
| 2020/0182238 | A1* | 6/2020 | Pellini | F02M 63/0245 |
| 2020/0182365 | A1* | 6/2020 | Pellini | F16K 17/048 |

* cited by examiner

FUEL SYSTEM CHECK VALVE

FIELD

The present description relates to a fuel system check valve and method for operating the fuel system check valve.

BACKGROUND AND SUMMARY

Fuel injected engines may include a fuel rail, fuel pump, fuel injectors, and a fuel filter. The fuel pump may supply pressurized fuel to the fuel rail where fuel injectors may inject fuel to cylinders of an engine. If the fuel pump is stopped there may be potential for fuel to flow back and past the fuel pump, thereby reducing pressure in the fuel rail. The reduced pressure in the fuel rail may lengthen engine starts when the engine is warm. One way to maintain pressure in the fuel rail so that the engine may quickly be restarted is to install a check valve in a fuel line that couples the fuel pump to the fuel rail. The check valve may reduce fuel pressure loss between frequent engine starts, but it may also contribute to evaporative emissions while an engine is stopped. In particular, a check valve may be configured to open at a low pressure differential in a forward flow direction (e.g. a direction that fluid flows from the fuel pump) when a fuel pump supplies fuel to the fuel rail. By the check valve opening at a lower pressure differential, the fuel pump may consume less energy when it is operating. However, if a vehicle that includes the fuel pump and check valve is stopped and it is exposed to diurnal heating and cooling, a vacuum may develop in a fuel line and fuel rail when fuel in the fuel line cools. The vacuum may pull fuel from the tank through the fuel pump and check valve to enter the fuel rail. During subsequent diurnal heating, the fuel that was admitted into the fuel rail may increase in pressure, which may allow it to slip past fuel injector nozzles and into engine cylinders where it may contribute to evaporative emissions during engine-off. This process may be repeated several times if a vehicle is parked and is allowed to undergo diurnal heating and cooling over several days. Therefore, it may be desirable to provide a way controlling/limiting pressure within a fuel system that may be exposed to diurnal heating and cooling.

The inventors herein have recognized the above-mentioned issues and have developed a check valve for a fuel system, comprising: a housing including a first inner cavity having a first area and a second inner cavity having a second area, the first area greater than the second area; and a stepped piston including a first stage part and a second stage part, a diameter of the first stage part being greater than a diameter of the second stage part.

By limiting fuel flow in a fuel system via a check valve that includes a stepped piston, it may be possible to hold the check valve closed during diurnal conditions so that subsequent pressure build up during diurnal conditions may be avoided. In addition, once open, the stepped check valve may be held open with very little pressure difference across the valve so that power consumption of a fuel pump may be reduced.

The present description may provide several advantages. Specifically, the approach may reduce evaporative emissions from an engine of a vehicle. In addition, the approach may allow a fuel pump to pump efficiently since the check valve may be held open via a low pressure difference across the check valve. In addition, the approach may simplify fuel system design.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where:

FIGS. 1-5B are drawn approximately to scale, however, other relative dimensions may be used, in other embodiments.

DETAILED DESCRIPTION

The present description is related to a check valve for a fuel line of a vehicle and operation of the check valve while an engine of the vehicle is stopped. The vehicle may undergo diurnal heating and cooling, but fuel pressure in a fuel rail may be limited by the check valve so that a possibility of unintended discharge of fuel from fuel injectors may be reduced. The check valve may be incorporated into a fuel line for an engine of the type shown in FIG. 1. The fuel line may be included in a fuel system as shown in FIGS. 2A and 2B. The check valve may be configured as shown in FIGS. 3-5B. The check valve may operate according to the sequence shown in FIG. 6 and the method of FIG. 7.

Figure 1:
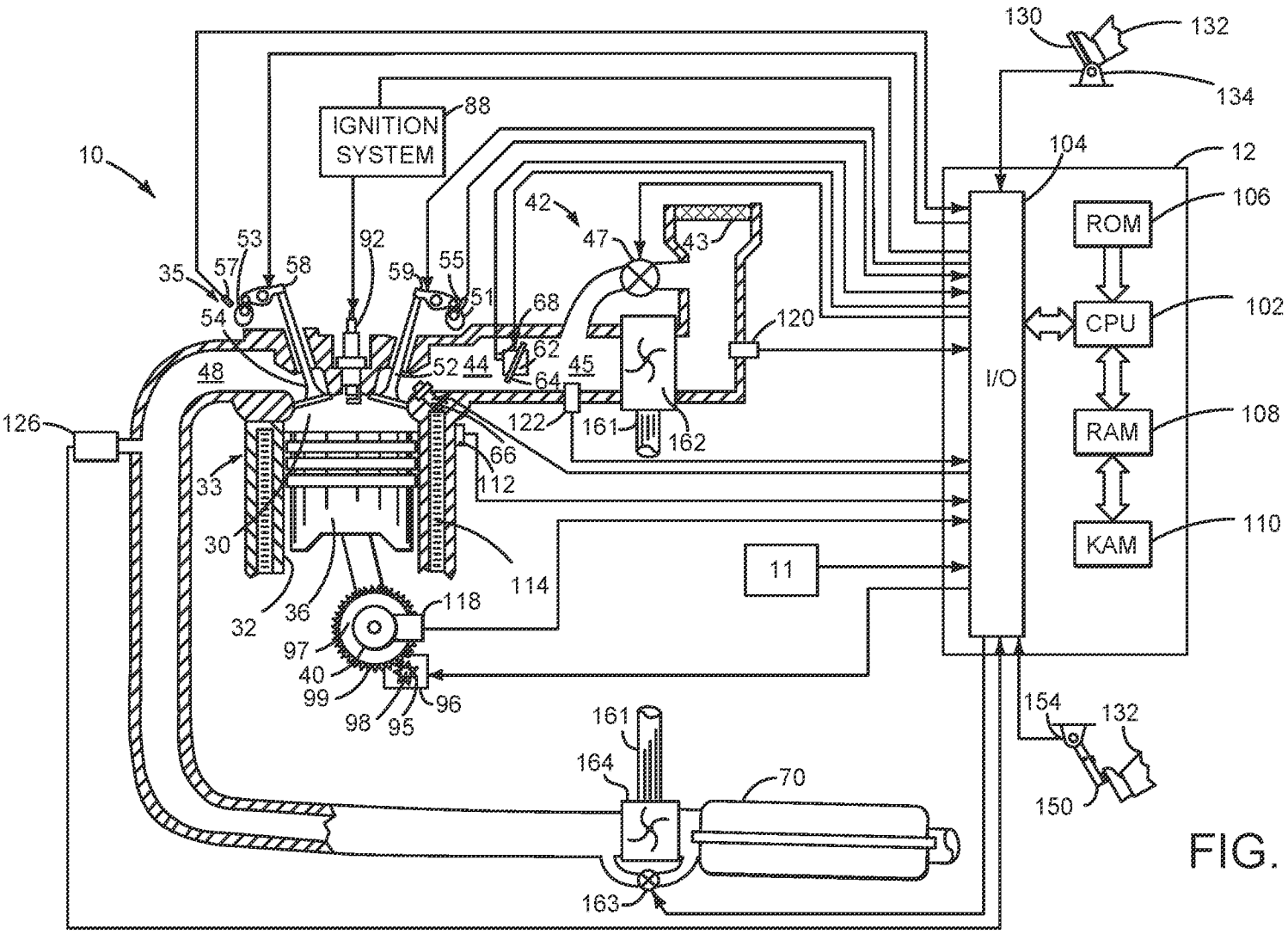
FIG. 1 is a schematic diagram of a cut-away of a single cylinder of an engine.
Figure 2B:
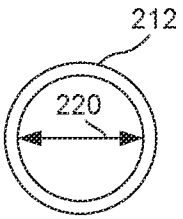
FIG. 2B shows a cross section of a fuel line.
Figure 2A:
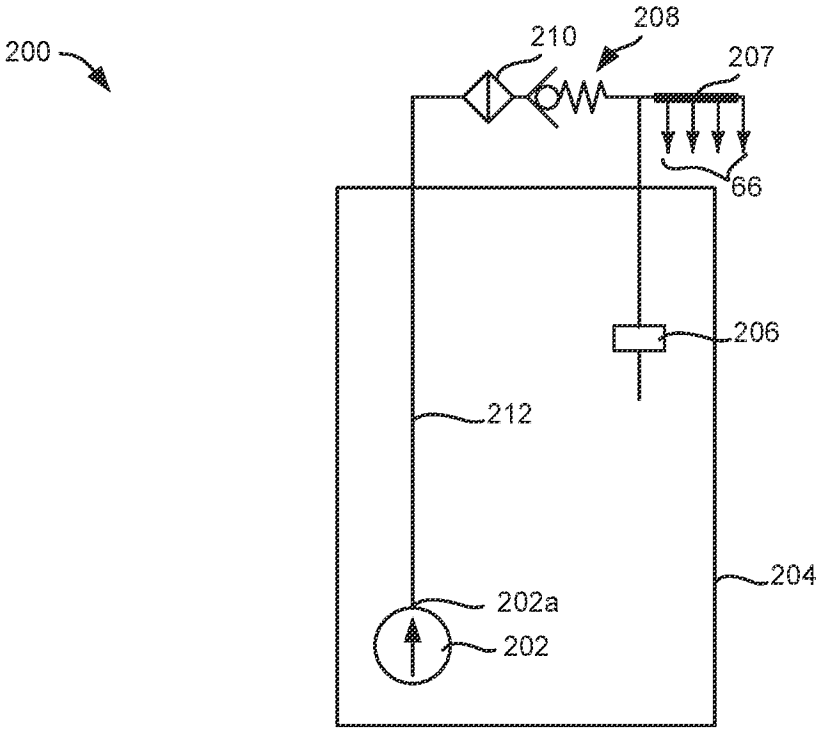
FIG. 2A is a schematic diagram that shows a fuel system including a check valve that includes a stepped piston.

Referring to FIG. 1, internal combustion engine 10, comprising a plurality of cylinders, one cylinder of which is shown in FIG. 1, is controlled by electronic engine controller 12. The controller 12 receives signals from the various sensors shown in FIG. 1 and employs the actuators shown in FIG. 1 to adjust engine operation based on the received signals and instructions stored in memory of controller 12.

Engine 10 is comprised of cylinder head 35 and block 33, which include combustion chamber 30 and cylinder walls 32. Piston 36 is positioned therein and reciprocates via a connection to crankshaft 40. Flywheel 97 and ring gear 99 are coupled to crankshaft 40. Optional starter 96 (e.g., low voltage (operated with less than 30 volts) electric machine) includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply power to crankshaft 40 via a belt or chain. In one example, starter 96 is in a base state when not engaged to the engine crankshaft.

Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake valve 52 may be selectively activated and deactivated by valve activation/deactivation device 59. In this example, valve activation/deactivation device 59 is an activating/deactivating rocker arm. Exhaust valve 54 may be selectively activated and deactivated by valve activation/deactivation device 58. In this example, valve activation/deactivation device 58 is an activating/deactivating rocker arm. Valve activation devices 58 and 59 may be electromechanical devices and they may take the form of rocker arms or other valve activating/deactivating devices (e.g., adjustable tappets, lost motion devices, etc.) in other examples.

Port fuel injector 66 is shown positioned to inject fuel into an intake port of cylinder 30, which is known to those skilled in the art as port injection. Fuel injector 66 delivers liquid fuel in proportion to pulse widths provided by controller 12. Fuel is delivered to fuel injector 66 by a fuel system (not shown) including a fuel tank, fuel pump, and fuel rail (not shown). In other examples, the system may include direct fuel injectors or central fuel injectors.

In addition, intake manifold 44 is shown communicating with turbocharger compressor 162 and engine air intake 42. In other examples, compressor 162 may be a supercharger compressor. Shaft 161 mechanically couples turbocharger turbine 164 to turbocharger compressor 162. Optional electronic throttle 62 adjusts a position of throttle plate 64 to control air flow from compressor 162 to intake manifold 44. Pressure in boost chamber 45 may be referred to a throttle inlet pressure since the inlet of throttle 62 is within boost chamber 45. The throttle outlet is in intake manifold 44. In some examples, throttle 62 and throttle plate 64 may be positioned between intake valve 52 and intake manifold 44 such that throttle 62 is a port throttle. Compressor recirculation valve 47 may be selectively adjusted to a plurality of positions between fully open and fully closed. Waste gate 163 may be adjusted via controller 12 to allow exhaust gases to selectively bypass turbine 164 to control the speed of compressor 162. Air filter 43 cleans air entering engine air intake 42. Since FIG. 1 is a cut-away side view of engine 10, a second throttle is not visible.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of three-way catalyst 70. Alternatively, a two-state exhaust gas oxygen sensor may be substituted for UEGO sensor 126.

Catalyst filter 70 can include multiple bricks and a three-way catalyst coating, in one example. In another example, multiple emission control devices, each with multiple bricks, can be used.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to a propulsive effort pedal 130 (e.g., a human/machine interface) for sensing force applied by human driver 132; a position sensor 154 coupled to brake pedal 150 (e.g., a human/machine interface) for sensing force applied by human driver 132, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 68. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

Controller 12 may also receive input from human/machine interface 11. A request to start the engine or vehicle may be generated via a human and input to the human/machine interface 11. The human/machine interface 11 may be a touch screen display, pushbutton, key switch or other known device.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational power of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Referring now to FIG. 2A, a detailed view of a fuel system that may supply fuel to engine 10 is shown. Fuel system 200 includes a fuel pump 202, a fuel filter 210, fuel line 212, a check valve system 208, fuel injectors 66, a fuel regulator 206, fuel rail 207, and a fuel tank 204. Fuel filter 210 and check valve system 208 are shown outside of fuel tank 204, but in some examples they may be positioned inside of fuel tank 204. Fuel pump 202 provides motive force to move fuel from fuel tank 204 to fuel filter 210 where contaminants may be removed from the fuel. Pressurized fuel may open check valve system 208 allowing fuel to flow to fuel rail 67 and fuel injectors 66. Check valve system 208 may be positioned along fuel line 212 downstream of outlet 202*a* of fuel pump 202 and fuel filter 210 so that compliance of fuel filter 210 may not affect fuel pressure in fuel rail 67 during diurnal heating and cooling of the fuel system.

Referring now to FIG. 2B, a cross section of fuel line 212 is shown. Fuel line 212 has an inside diameter 220 that is hollow to allow fuel to flow through. The inside diameter 220 may influence the amount of fuel that may flow through fuel line 212 in a given amount of time.

Figure 3:
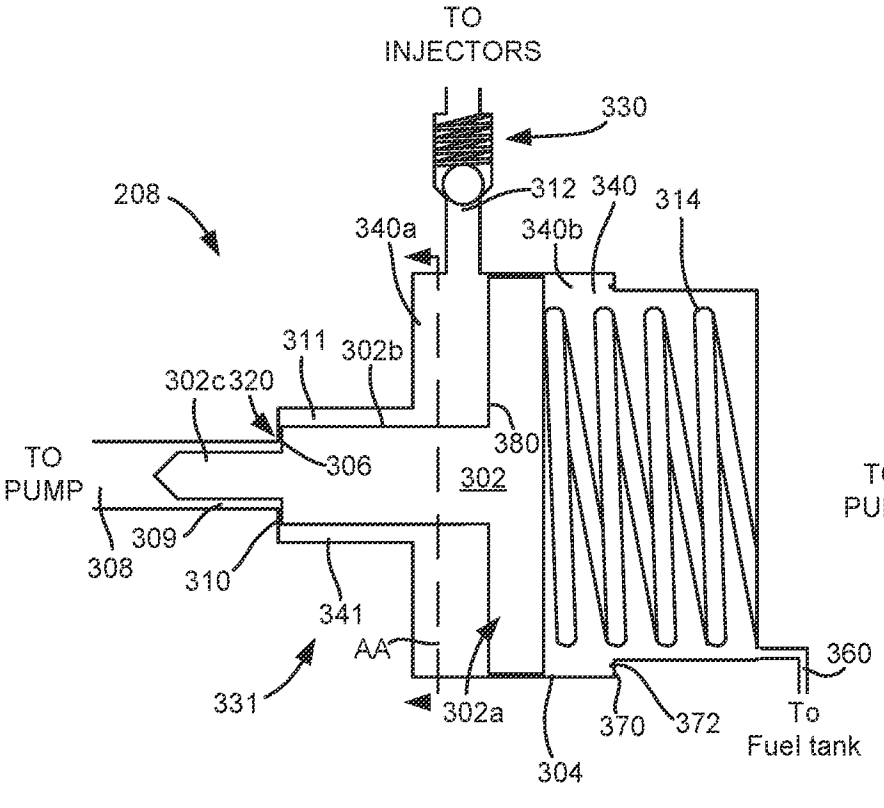

Referring now to FIG. 3, an example check valve system or fuel line check valve system 208 is shown. In this example, check valve system 208 includes a first check valve 330 and a stepped piston check valve 331. Stepped piston check valve 331 includes a stepped piston 302 includes three steps, but in other examples, it may have two steps. Stepped check valve 331 is comprised of a housing 304, spring 314, and a stepped piston 302. In some examples, housing 304 may comprise two or more pieces.

Housing 304 may include a first inner cavity 340, a second inner cavity 341, and a third inner cavity or inlet port 308. The first, second, and third inner cavities may be cylindrical in shape. An outlet port 312 and a weep port 360 may allow fuel to exit stepped check valve 331. In particular, weep port 360 may return fuel that passes by stepped piston 320 to fuel tank 204. Second inner cavity 341 includes a sealing face 310, which may be in contact with stepped piston 302 to prevent fuel from flowing through check valve 208. Seal face 310 may include a seal 320, in some examples. Housing 304 may also include a second sealing face 370 and seal 372 to prevent fuel flow past stepped piston 302 when stepped piston check valve 331 is fully open. Spring 355 may bias stepped piston 302 to a fully closed position as shown in FIG. 3.

Stepped piston 302 is shown with a first stage 302*a* that is positioned within first inner cavity 340 of housing 304. Stepped piston 302 and first stage 302*a* may be cylindrical is shape. However, stepped piston 302 and first stage 302*a* may take other shapes in other examples. First stage 302*a* includes a working face 380 that fuel may apply pressure to in order for stepped check valve 331 to remain open. Stepped piston 302 also includes a second stage 302*b* that is positioned within second inner cavity 341 of housing 304. Second stage 302*b* may also be cylindrical in shape. Second stage 302*b* includes a sealing face 306 that may be in contact with sealing face 310 of housing 304 when check valve 208 is fully closed. In some examples, stepped piston 302 may also include a third stage 302*c* that is positioned within third inner cavity 308 of housing 304.

Sealing face 306 may have an area that is sized so that force of spring 314 is overcome when a predetermined fuel pressure (e.g., 75 Kilopascals) differential is present between inlet port 308 and weep port 360. Working face 380 may have an area that is sized so that force of spring 314 is overcome when a predetermined fuel pressure (e.g., 17 Kilopascals (kPa)) differential is present between inlet port 308 and weep port 360. Thus, once check valve 208 is open, a mere 17 kPa pressure differential may keep check valve 208 open so that fuel pump efficiency may be high. Said another way, once flow is occurring through stepped check valve 331, the check valve presents a 17 kPa pressure drop. Stepped piston check valve 331 remains closed until the pump outlet pressure is a predetermined pressure (e.g., 75 kPa) above fuel tank pressure. Once stepped piston check valve 331 is open, it stays open as long as pump outlet pressure remains at least 17 kPa above fuel tank pressure. When stepped piston check valve 331 is open, conventional check valve 330 governs the allowed fuel flow direction while it imposes a minimal pressure drop. The pressure loss across conventional check valve 330 may be in a range of 5-20 kPa.

The first inner cavity 340 may be split into a working chamber 340*a* and a spring chamber 340*b* when stepped piston 302 is within housing 304. Area 311 between second inner chamber 341 and second stage 302*a* may be sized equal to or larger than an area associated an inside diameter of a fuel line 212 that supplies fuel to check valve 208. By sizing the area 311 to be equal to or larger than an area associated with an inside diameter of a fuel line (e.g., $\text{Area}=\pi\cdot(d/2)^2$, where d is the inside diameter of the fuel line) of the fuel system, it may be possible to reduce a pressure drop across the check valve and provide a desired amount of fuel to the engine. Likewise, area 309 between third inner cavity 308 and third stage 302*c* may be sized equal to or larger than an area associated an inside diameter of a fuel line 212 that supplies fuel to check valve 208.

The check valve system 208 operates as follows: First, conventional check valve 330 is downstream of stepped check valve 331 in the direction of fuel flow when the fuel pump is on. Check valve 330 prevents fuel flow from the fuel rail back to the tank when fuel pressure in the stepped check valve 331 is less than fuel pressure in the fuel rail. It also takes 17 kPa to open to impede natural, unintentional siphoning out of the tank if there is a break in the downstream fuel line and the fuel pump is off. The stepped check valve 331 prevents a deep vacuum that may occur in the fuel from forming and refilling the fuel rail during pump off. The stepped check valve 331 opens when the fuel pump pressure exceeds tank pressure by 75 kPa, which it easily does anytime the pump is on. However, unlike a typical two-port check valve, the stepped check valve 331 does not provide a pressure drop when open or fuel is flowing. It simply "gets out of the way" if the pump pressure is 75 kPa above the tank pressure, which occurs anytime the pump is on. When the fuel pump 202 is off, the stepped check valve 331 is closed. The stepped check valve's inlet is exposed to tank pressure when it is closed and the only way to open it then is with vacuum. The fuel rail would need a vacuum of 75+17=92 kPa to open the stepped check valve. However, the fuel line and fuel rail cannot produce this vacuum level during diurnal heating and cooling. Thus, the stepped check valve 331 remains closed during conditions of vacuum, thereby preventing the fuel system form refilling with fuel when the fuel pump is off. It may be noted that a plug-in hybrid electric vehicle may have pressure in its fuel tank up to 35 kPa. This makes it a pressurized fuel source so that its valves are made to impede at least 35 kPa of pressure. For this reason, pressurized fuel tanks use a check valve that has a 65 kPa impediment to pressure.

The stepped check valve 331 opens with a calibratable or tuned amount of pressure. The amount of pressure depends on the area of piston 302*b* and force of spring 314, which form a force balance. The piston 302*b* can have a seal 320 or just be close fitting as it is leak tolerant. This leak tolerance comes from the secondary seal which in this case is shown as a face seal 372 on the housing 304, or alternatively, on a back of the piston 302, making contact when there is appreciable piston pressure. When the pump 220 is off, the vacuum force required to open stepped check valve 331 is governed by the spring force and the area of second stage 302*b*.

The combination of stepped check valve 331 and check 330 gives the valve system the following desired behaviors: First, it prevents fuel flow from the fuel rail back to the tank at all conditions. In addition, the check valve system takes 17 kPa to open to impede natural, unintentional siphoning out of the tank if there is a break in the fuel line downstream of the check valve system and the fuel pump is off. Further, the check valve system prevents the vacuum pressure (tank pressure minus fuel vapor pressure) from drawing fuel into the fuel tank. Further still, if the fuel tank is pressurized (e.g., to 35 kPa), this means that the valve system needs a high pressure to open to accommodate unintentional siphoning. The way these valves are implemented, they have a 60 kPa or so pressure drop when flowing.

Figure 4:
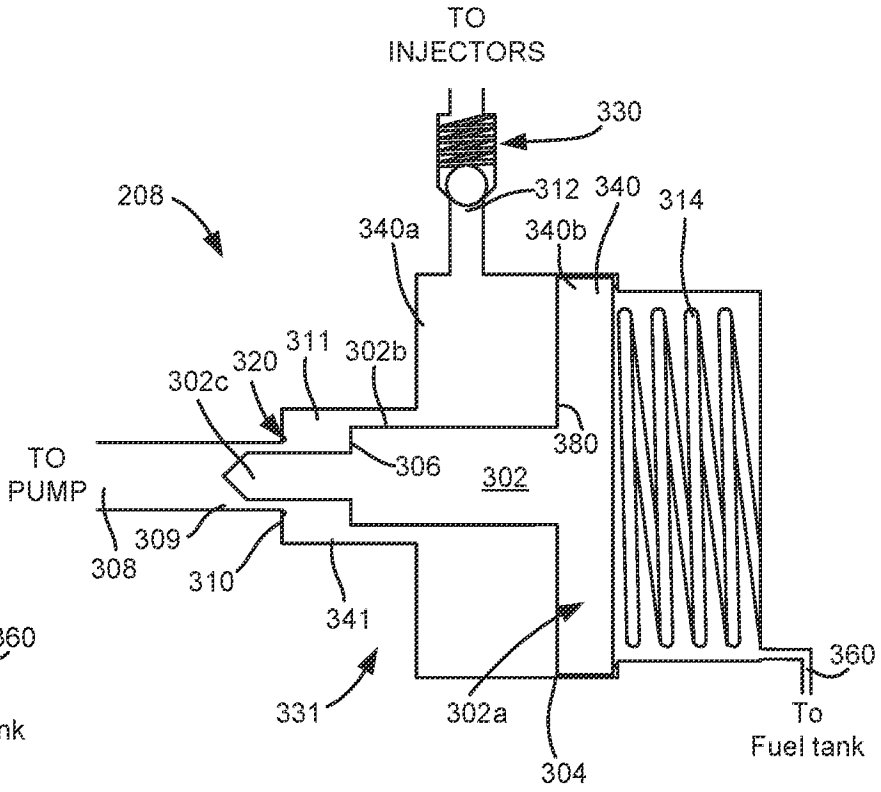
FIGS. 3 and 4 show cut-away views of a check valve that includes a stepped piston in closed and open positions.

FIG. 3 shows stepped check valve 331 in a fully closed position. FIG. 4 shows stepped check valve 331 in a full open position. Spring 314 may bias stepped check valve 331 to a fully closed position when fuel pump 202 is in an off state.

Figure 5B:
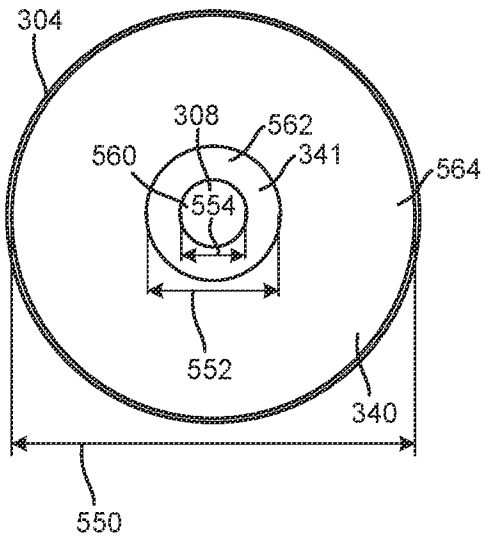
FIGS. 5A and 5B show plan views of an example stepped piston and an example housing of a check valve.
Figure 5A:
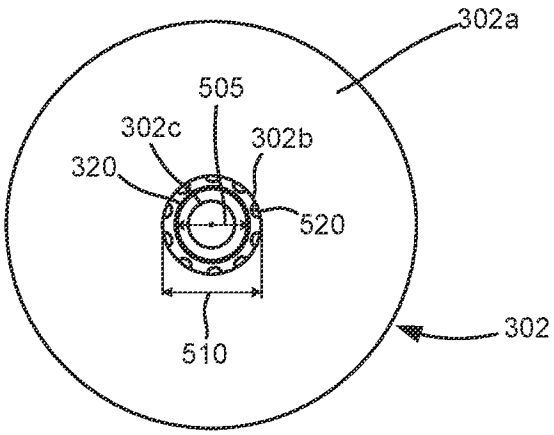

Referring now to FIG. 5A a plan view of stepped piston 302 is shown. In this example, stepped piston 302 is configured in a cylindrical shape. First stage 320 has a larger area than second stage 302*b* and third stage 302*c*. Seal 320 is shown to be annular in shape and it includes an outer diameter 505 that is less than the outer diameter 510 of second stage 302*b* so that seal 320 does not allow fuel to pass through check valve 302 when check valve 302 is fully closed. In some examples, second stage 302*b* may include flutes 520 so that the outer diameter 510 of second stage 320 may contact the second inner cavity 341 of check valve 304 while fuel flows through the flutes and on to the fuel rail 207 and fuel injectors 66. Thus, there is a step change in the diameter of stepped piston 302 from the third stage 302*c* to the second stage 302*b*. Likewise, there is a step change in the diameter of stepped piston 302 from the second stage 302*b* to the first stage 302*a*.

Referring now to FIG. 5B, a plan view of housing 304. In this example, housing 304 is cylindrical, but in other examples it may take other shapes. First inner cavity 340 includes a diameter 550 that is larger than the second inner cavity diameter 552. First inner cavity 340 also includes an area 564 that is greater than an area 562 of the second inner cavity 341. The second inner cavity diameter 552 is greater than the third inner cavity diameter 554. Area 562 of second inner cavity 341 is greater than an area 560 of the third inner cavity 308.

Thus, according to FIGS. 5A and 5B, stepped piston 302 may slide into housing 340. The stepped piston may control fuel flow through the check valve 208 such that fuel may flow in a direction from the fuel pump 202 (shown in FIG. 2) to fuel injectors 66. Check valve 208 may prevent fuel flow from fuel rail 207 to fuel pump 202 when fuel pump 202 is deactivated. Check valve 208 may also prevent fuel flow from fuel pump 202 to fuel injectors 66 while a fuel pressure differential across check valve 208 is less than a threshold. Consequently, check valve 208 may prevent fuel flow into the fuel rail 207 when the fuel rail 207 and fuel system components downstream of check valve 208 (in the direction of fuel flow from fuel pump 202 to fuel injectors 66) undergo diurnal cooling when a vehicle's engine is deactivated.

The system of FIGS. 1-5B provides for a check valve for a fuel system, comprising: a housing including a first inner cavity having a first area and a second inner cavity having a second area, the first area greater than the second area; and a stepped piston including a first stage part and a second stage part, a diameter of the first stage part being greater than a diameter of the second stage part. The check valve further comprises a spring, the spring biasing the check valve to a closed position, where the first stage part is at least partially inserted into the first inner cavity when the check valve is in the closed position, and where the second stage part is completely inserted into the second stage part when the check valve is in the closed position. The check valve further comprises an inlet in the housing, an outlet in the housing, and a weep port in the housing. The check valve further comprises a seal coupled to the first stage part. The check valve further comprises flutes in the first stage part. The check valve further comprises a third stage part included in the stepped piston, the third stage part having a diameter that is less than the diameter of the second stage part. The check valve includes where the first stage part and the second stage part are cylindrical in shape.

The system of FIGS. 1-5B also provides for a fuel system, comprising: a fuel pump; a fuel filter arranged in a fuel line downstream of the fuel pump; a check valve arranged in the fuel line downstream of the fuel filter, the check valve comprising: a housing including a first inner cavity having a first area and a second inner cavity having a second area, the first area greater than the second area; a stepped piston including a first stage part and a second stage part, a diameter of the first stage part being greater than a diameter of the second stage part; and a fuel rail arranged in the fuel line downstream of the check valve. The fuel system further comprises a spring, the spring biasing the check valve to a closed position, where the first stage part is at least partially inserted into the first inner cavity when the check valve is in the closed position, and where the second stage part is completely inserted into the second stage part when the check valve is in the closed position. The fuel system further comprises flutes in the first stage part. The fuel system includes where the first stage part and the second stage part are cylindrical in shape. The fuel system further comprises an inlet in the housing, an outlet in the housing, and a weep port in the housing.

Figure 6:
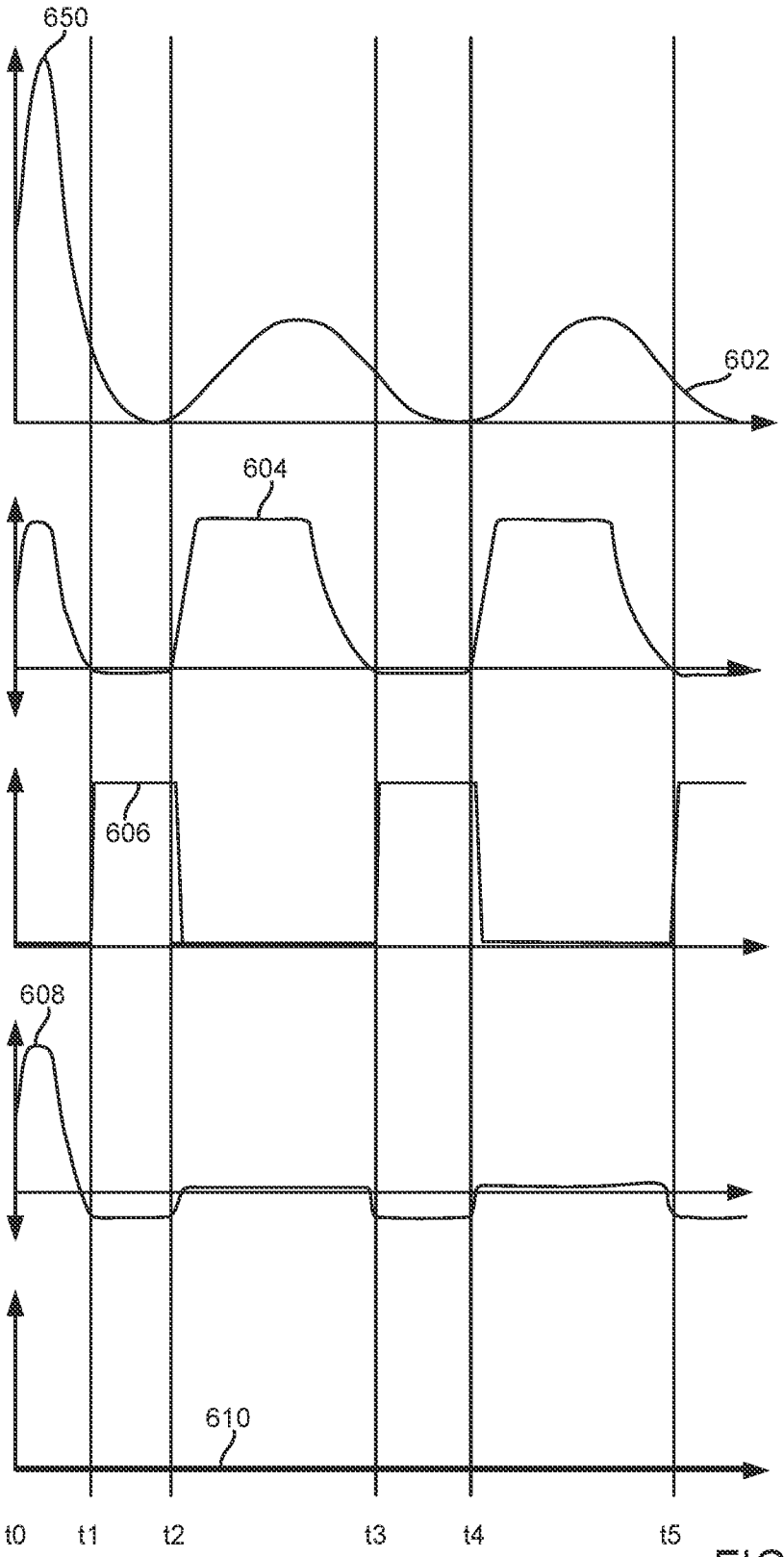
FIG. 6 shows a diurnal sequence that contrasts operation of a fuel system that includes a prior art check valve and operation of a fuel system that includes a check valve according to the present disclosure.

Referring now to FIG. 6, a prophetic example operating sequence for a conventional fuel line check valve is contrast with an operating sequence for the check valve described herein. The operating sequence illustrates three diurnal heating and cooling periods, and the conventional fuel line check valve and the check valve described herein are exposed to the same operating conditions. The plots are time aligned and occur at a same time.

The first plot from the top of FIG. 6 is a plot of fuel system temperature (e.g., fuel temperature within a fuel rail of fuel systems that include the conventional check valve and the check valve described herein) when a vehicle's engine is stopped and the vehicle is stationary. The vertical axis represents temperature and temperature increases in the direction of the vertical axis arrow. The horizontal axis represents time and time increases from the left side of the figure to the right side of the figure. Trace 602 represents temperature in the fuel system. The low diurnal temperature may be 65° F. and the high might be 105° F. while the underhood peak temperature occurring typically 20 minutes past engine off may be 145° F.

The second plot from the top of FIG. 6 is a plot of fuel rail pressure for a fuel system that includes a conventional check valve when a vehicle's engine is stopped and the vehicle is stationary. The vertical axis represents pressure and pressure increases in the direction of the vertical axis arrow. The horizontal axis represents time and time increases from the left side of the figure to the right side of the figure. Trace 604 represents pressure in the fuel system.

The third plot from the top of FIG. 6 is a plot of conventional check valve metering valve position versus time. The vertical axis represents the conventional check valve metering valve position and the conventional check valve opening amount increases as the check valve metering valve position increases in the direction of the vertical axis arrow. The horizontal axis represents time and time increases from the left side of the figure to the right side of the figure. Trace 606 represents the conventional check valve metering valve position.

The fourth plot from the top of FIG. 6 is a plot of fuel rail pressure for a fuel system that includes the stepped check valve described herein when a vehicle's engine is stopped and the vehicle is stationary. The vertical axis represents pressure and pressure increases in the direction of the vertical axis arrow. The horizontal axis represents time and time increases from the left side of the figure to the right side of the figure. Trace 608 represents pressure in the fuel system.

The fifth plot from the top of FIG. 6 is a plot of stepped check valve piston position versus time. The vertical axis represents the stepped check valve piston position and the stepped check valve piston position opening amount increases as the stepped check valve piston position increases in the direction of the vertical axis arrow. The horizontal axis represents time and time increases from the left side of the figure to the right side of the figure. Trace 610 represents the stepped check valve piston position.

At time t0, an engine of a vehicle that is combusting fuel stops combusting fuel and is stopped (not shown). Pressure in the engine's fuel line begins to increase as heat from the engine is not removed from the engine compartment since the engine is off. Pressure in the fuel rail of fuel system with the conventional check valve increases as temperature (thus volume) within the fuel rail is increased. The conventional check valve is fully closed at time t0. Pressure in the fuel rail of fuel system with the check valve described herein also increases as temperature within the fuel rail is increased. The check valve described herein is fully closed at time t0.

Between time t0 and time t1, the temperature of the fuel system increases and then it decreases as the fuel system is cooled toward ambient temperature. Pressure in the fuel rail of fuel system with the conventional check valve increases and then decreases as temperature within the fuel rail is increased and decreased. The conventional check valve is fully closed. Pressure in the fuel rail of fuel system with the check valve described herein also increases and then decreases as temperature within the fuel rail is increased. The check valve described herein remains fully closed. The peak pressure may be limited at this stage by the pressure regulator 206.

At time t1, the temperature of the fuel system has been reduced low enough for a vacuum to be generated in the fuel line of the system that includes the conventional check valve. This occurs when the fuel's vapor pressure drops below atmospheric pressure. For example, if the fuel rail contains some air, the pressure may be slightly above fuel vapor pressure. Dissolved air comes out of the fuel when it drops below atmospheric pressure due to the Bunsen effect. The vacuum is large enough to cause the conventional check valve to open, which allows additional fuel to enter the fuel rail from the fuel tank. The vacuum overcomes the spring force within the conventional check valve since the conventional check valve is designed to open at a lower pressure differential. A vacuum is also generated in the fuel system that includes the check valve described herein; however, the check valve described herein remains closed since it is designed to open at a higher pressure differential than the conventional check valve. Thus, the check valve described herein prevents additional fuel from entering the fuel system. By preventing additional fuel from entering the fuel system, it may be possible for pressure in the fuel system to remain lower during diurnal heating.

Between time t1 and time t2, the temperature of the fuel system is reduced further and the vacuum in the fuel line of the system that includes the conventional check valve is maintained. The vacuum continues to hold the conventional check valve to open, which allows additional fuel to enter the fuel rail from the fuel tank. Vacuum in the fuel system that includes the check valve described herein is maintained, but the check valve described herein remains closed since it is designed to open at a higher pressure.

At time t2, the temperature of fuel in the fuel system begins to increase due to diurnal heating. The increase in temperature begins to raise pressure in the system that includes the conventional check valve. The conventional check valve remains open. The increase in temperature also raises pressure in the system that includes the check valve described herein. The check valve described herein remains closed.

Between time t2 and time t3, temperature in the fuel systems increases and then it decreases due to diurnal heating and cooling as the vehicle's engine remains off. Pressure in the fuel system that includes the conventional check valve increases and then it decreases. When higher pressures are in the fuel system, the possibility of fuel unintentionally entering the engine from fuel injectors may increase. Pressure in the fuel system that includes the check valve that is described herein increases and then it decreases, but its pressure increase is significantly lower than that of the system that includes the conventional check valve because less fuel may be in the fuel rail of the system that includes the check valve described herein. The conventional check valve is closed and the check valve described herein remains closed. Conventionally, the fuel system drinks in fuel as the temperature drops (and forms a vacuum) and pushes out fuel when the temperature climbs (once reaching the regulated pressure).

At time t3, the temperature of the fuel system has been reduced low enough for a vacuum to be generated in the fuel line of the system that includes the conventional check valve a second time. The vacuum is large enough to cause the conventional check valve to open, which allows additional fuel to enter the fuel rail from the fuel tank again. A vacuum is also generated in the fuel system that includes the check valve described herein again, but the check valve described herein remains closed since it is designed to open at a higher pressure differential than the conventional check valve.

Between time t3 and time t4, the temperature of the fuel system is reduced further and the vacuum in the fuel line of the system that includes the conventional check valve is maintained. The vacuum continues to hold the conventional check valve to open, which allows additional fuel to enter the fuel rail from the fuel tank. Vacuum in the fuel system that includes the check valve described herein is maintained, but the check valve described herein remains closed since it is designed to open at a higher pressure.

At time t4, the temperature of fuel in the fuel system begins to increase due to diurnal heating. The increase in temperature begins to raise pressure in the system that includes the conventional check valve. The conventional check valve remains open. The increase in temperature also raises pressure in the system that includes the check valve described herein. The check valve described herein remains closed.

Between time t4 and time t5, temperature in the fuel systems increases and then it decreases due to diurnal heating and cooling as the vehicle's engine remains off. Pressure in the fuel system that includes the conventional check valve increases and then it decreases. Pressure in the fuel system that includes the check valve that is described herein increases and then it decreases, but again, its pressure increase is significantly lower than that of the system that includes the conventional check valve because less fuel may be in the fuel rail of the system that includes the check valve described herein. The conventional check valve is closed and the check valve described herein remains closed.

At time t5, the temperature of the fuel system has been reduced low enough for a vacuum to be generated in the fuel line of the system that includes the conventional check valve a second time. The vacuum is large enough to cause the conventional check valve to open, which allows additional fuel to enter the fuel rail from the fuel tank again. A vacuum is also generated in the fuel system that includes the check valve described herein again, but the check valve described herein remains closed since it is designed to open at a higher pressure differential than the conventional check valve.

Thus, in the fuel system with the conventional check valve, fuel in the fuel rail may be recharged via diurnal heating and cooling so that a possibility of fuel entering the engine via the fuel injectors may increase. On the other hand, the fuel system that includes the check valve described herein does not allow additional fuel to enter the fuel rail during diurnal cooling so that a possibility of fuel pressure increasing to a point where fuel flows through the fuel injectors during diurnal heating may be reduced.

Figure 7:
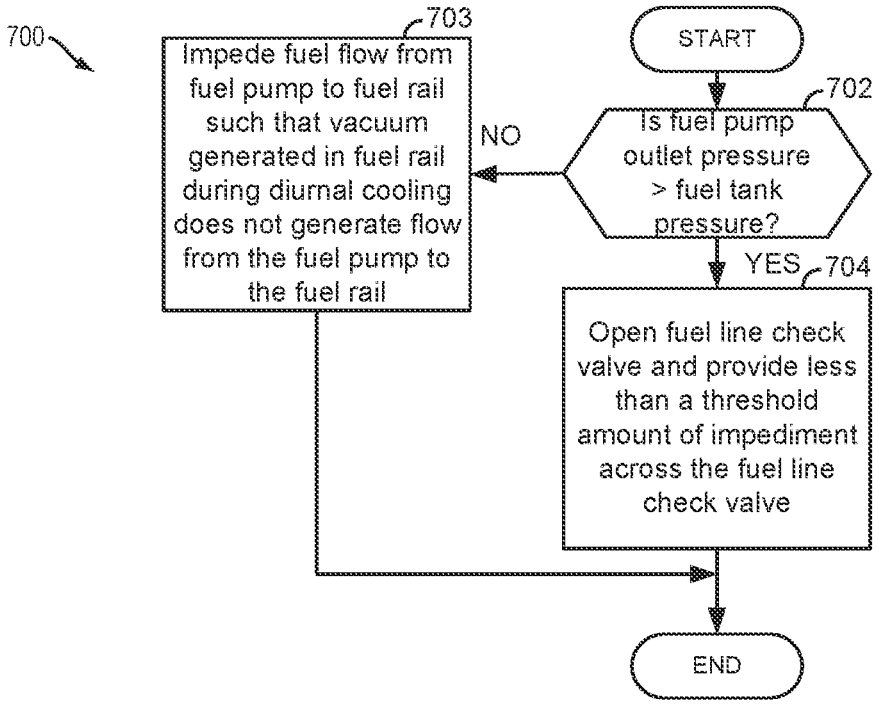
FIG. 7 shows a flow chart of a method for operating a fuel system that includes a stepped check valve.

Referring now to FIG. 7, a flow chart of a method for operating an engine that includes a check valve as described herein is shown. The method of FIG. 7 may be performed via the system shown in FIGS. 1-5B.

At 702, method 700 judges if the fuel pump's outlet pressure is greater than fuel tank pressure. If so, the answer is yes and method 700 proceeds to 704. Otherwise, the answer is no and method 700 proceeds to 703. The stepped check valve described herein may prevent opening of the stepped fuel line check valve while a fuel pressure difference across the fuel line check valve is less than a first fuel pressure difference (e.g., pressure difference between the fuel pump outlet and the fuel tank)/The stepped check valve may be prevented from opening via the area of a first stage part of the stepped check valve and a spring. The stepped check valve described herein may also remain open in response to a reduced fuel pressure difference between pressure at the outlet of the fuel pump and fuel tank pressure. The stepped check valve may remain open at a reduced pressure difference between the outlet pressure of the fuel pump and the fuel tank via an area of a second stage part of the fuel line check valve piston and the spring after the fuel line check valve begins to open.

At 704, method 700 opens the fuel line check valve and provides less than a threshold amount of impediment (e.g., less than 17 kPa) to fuel flow across the fuel line check valve. Method 700 proceeds to exit.

At 703, method 700 impedes fuel flow from the fuel pump to the fuel rail such that vacuum generated in the fuel rail during diurnal cooling or fuel tank pressure is insufficient to generate flow from the fuel pump to the fuel rail. The fuel pump is off during diurnal heating and cooling. Method 700 proceeds to exit.

In this way, the check valve described herein may open at a first pressure, but it may be held open via a lower pressure so that pumping efficiency may remain high. In addition, the check valve described herein may prevent fuel from passing through the check valve during diurnal heating and cooling of the fuel system.

Thus, the method of FIG. 7 provides for a method for a fuel system, comprising: preventing opening of a fuel line check valve while a fuel pressure difference across the fuel line check valve is less than a first fuel pressure difference via a spring and a second stage part of a fuel line check valve piston; and reducing an opening fuel pressure difference of the fuel line check valve to less than the first fuel pressure difference via a first stage part of the fuel line check valve piston and the spring after the fuel line check valve begins to open.

The method further comprises flowing a fuel from a fuel pump to a fuel rail including flowing the fuel through the fuel line check valve. The method further comprises closing the fuel line check valve via deactivating a fuel pump. The method further comprises preventing a fuel from flowing through the check valve when a vacuum forms in a fuel line that includes the check valve while the fuel pump is deactivated. The method includes where the fuel is prevented from flowing through the check valve via a stepped piston and a spring. The method includes where a second stage of the stepped piston and spring are configured to hold the fuel line check valve closed for fuel pressures less than a first threshold pressure. The method further comprises returning fuel to a fuel tank via a weep port when fuel passes between a housing of the fuel line check valve and the fuel line check valve piston. The method includes where the fuel pressure difference across the fuel line check valve is generated at least in part via a vacuum.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, at least a portion of the described actions, operations and/or functions may graphically represent code to be programmed into non-transitory memory of the computer readable storage medium in the control system. The control actions may also transform the operating state of one or more sensors or actuators in the physical world when the described actions are carried out by executing the instructions in a system including the various engine hardware components in combination with one or more controllers.

This concludes the description. The reading of it by those skilled in the art would bring to mind many alterations and modifications without departing from the spirit and the scope of the description. For example, single cylinder, I3, I4, I5, V6, V8, V10, and V12 engines operating in natural gas, gasoline, diesel, or alternative fuel configurations could use the present description to advantage.

The invention claimed is:

1. A check valve for a fuel system, comprising:

a housing including a first inner cavity having a first area and a second inner cavity having a second area, the first area greater than the second area; and a stepped piston including a first stage part and a second stage part, a diameter of the first stage part being greater than a diameter of the second stage part.

2. The check valve of claim 1, further comprising a spring, the spring biasing the check valve to a closed position, where the first stage part is at least partially inserted into the first inner cavity when the check valve is in the closed position, and where the second stage part is completely inserted into the second stage part when the check valve is in the closed position.

3. The check valve of claim 2, further comprising an inlet in the housing, an outlet in the housing, and a weep port in the housing.

4. The check valve of claim of claim 3, further comprising a seal coupled to the first stage part.

5. The check valve of claim of claim 1, further comprising flutes in the first stage part.

6. The check valve of claim of claim 1, further comprising a third stage part included in the stepped piston, the third stage part having a diameter that is less than the diameter of the second stage part.

7. The check valve of claim of claim 1, where the first stage part and the second stage part are cylindrical in shape.

8. A method for a fuel system, comprising:

preventing opening of a fuel line check valve while a fuel pressure difference across the fuel line check valve is less than a first fuel pressure difference via a spring and a second stage part of a fuel line check valve piston; and reducing an opening fuel pressure difference of the fuel line check valve to less than the first fuel pressure difference via a first stage part of the fuel line check valve piston and the spring after the fuel line check valve begins to open.

9. The method of claim 8, further comprising flowing a fuel from a fuel pump to a fuel rail including flowing the fuel through the fuel line check valve.

10. The method of claim 8, further comprising closing the fuel line check valve via deactivating a fuel pump.

11. The method of claim 10, further comprising preventing a fuel from flowing through the check valve when a vacuum forms in a fuel line that includes the check valve while the fuel pump is deactivated.

12. The method of claim 11, where the fuel is prevented from flowing through the check valve via a stepped piston and a spring.

13. The method of claim 12, where the second stage part of the stepped piston and spring are configured to hold the fuel line check valve closed for fuel pressures less than a first threshold pressure.

14. The method of claim 8, further comprising returning fuel to a fuel tank via a weep port when fuel passes between a housing of the fuel line check valve and the fuel line check valve piston.

15. The method of claim of claim 8, where the fuel pressure difference across the fuel line check valve is generated at least in part via a vacuum.

16. A fuel system, comprising:

a fuel pump;

a fuel filter arranged in a fuel line downstream of the fuel pump;

a first check valve arranged in the fuel line downstream of the fuel filter, the first check valve comprising:

a housing including a first inner cavity having a first area and a second inner cavity having a second area, the first area greater than the second area;

a stepped piston including a first stage part and a second stage part, a diameter of the first stage part being greater than a diameter of the second stage part;

a second check valve arranged downstream of the first check valve; and a fuel rail arranged in the fuel line downstream of the second check valve.

17. The fuel system of claim 16, further comprising a spring, the spring biasing the first check valve to a closed position, where the first stage part is at least partially inserted into the first inner cavity when the first check valve is in the closed position, and where the second stage part is completely inserted into the second stage part when the first check valve is in the closed position.

18. The fuel system of claim 16, further comprising flutes in the first stage part.

19. The fuel system of claim 16, where the first stage part and the second stage part are cylindrical in shape.

20. The fuel system of claim 16, further comprising an inlet in the housing, an outlet in the housing, and a weep port in the housing.

* * * * *